United States Patent [19]

Hume

[11] 4,428,215

[45] Jan. 31, 1984

[54] PLATE BENDING METHOD

[76] Inventor: Kenneth M. Hume, 8 Lister St., East Kew, Victoria, Australia

[21] Appl. No.: 303,515

[22] Filed: Sep. 18, 1981

[30] Foreign Application Priority Data

Sep. 19, 1980 [AU] Australia ..... PE5658

[51] Int. Cl.[3] ..... B21D 5/12

[52] U.S. Cl. ..... 72/133; 72/149

[58] Field of Search ..... 72/51, 52, 129, 133, 72/149; 140/88; 228/150, 151, 171; 138/170, 171

[56] References Cited

U.S. PATENT DOCUMENTS

| | | | |
|---|---|---|---|
| 172,606 | 1/1876 | Butler | 138/171 X |
| 2,706,328 | 4/1955 | Karmazin | 138/171 X |
| 2,730,135 | 1/1956 | Wallace | 228/171 X |
| 3,879,994 | 4/1975 | Hume | 72/149 X |
| 4,132,106 | 1/1979 | Bihler | 72/149 X |

FOREIGN PATENT DOCUMENTS

| | | | |
|---|---|---|---|
| 1265630 | 5/1961 | France | 228/171 |

*Primary Examiner*—E. Michael Combs

*Attorney, Agent, or Firm*—Schuyler, Banner, Birch, McKie & Beckett

[57] ABSTRACT

There is disclosed a method of rolling flat plate using a cylindrical mandrel and a plate gripper to form a pipe having a low pipe diameter to plate thickness ratio by forming a notch or recess in the plate edge to be gripped so that the combined radial dimension of the notched plate edge and gripper is no greater than the plate thickness.

2 Claims, 2 Drawing Figures

PLATE BENDING METHOD

This invention relates to plate bending machines and particularly to a machine as described in the inventor's earlier Australian Pat. No. 463,345. There is disclosed in the earlier patent specification a method and apparatus wherein a plate is rolled to form a cylindrical article wich comprises engaging a leading edge of the plate with a projecting rib on a mandrel so that the plate is tangential to the mandrel from the edge and rotating the mandrel while engaging the remainder of the plate by pressure rollers or the like to curve the plate about the mandrel.

The aim of the present invention is to modify and improve the therein disclosed method and apparatus thereby ensuring that the edge of the plate is properly gripped by the rib on the mandrel. More specifically, it is the aim of the invention to provide bending for plates of greater thickness than possible hitherto.

There is provided according to the present invention a method of rolling plate to form a curved or cylindrical article including engaging one edge of a length of plate between a mandrel and gripping means on the mandrel and turning the mandrel to curve the plate, the improvement comprising recessing or notching the edge of the plate to be gripped such that the combined dimension of the notched plate and gripping means is substantially the same as the plate thickness.

Conveniently the mandrel is turned in a direction towards the edge of the plate resulting in the plate being forced against said gripping means to bring about said engagement with said gripping means. A pair of pressure rollers are provided beneath said mandrel for engagement with the plate surface upon lowering of the mandrel before or during said engagement of the plate edge to ensure alignment of the plate edge with said gripper by engaging the plate edge continuously against the mandrel surface over the full length of the plate. A similar curving procedure is then followed as is disclosed in the previously mentioned patent specification.

The edge engagement procedure as described above when gripping the edge opposite said one edge is repeated prior to commencing the second stage of the curving procedure to thereby complete the formation of the cylindrical article. The notching or recessing of the plate edge enables curving of relatively thick plate on a relatively small diameter without fouling of the gripping rib against the free edge of the curved plate during the final stages of the curving operation.

The invention will be defined in more detail having reference to the accompanying drawings in which.

Figure 1:
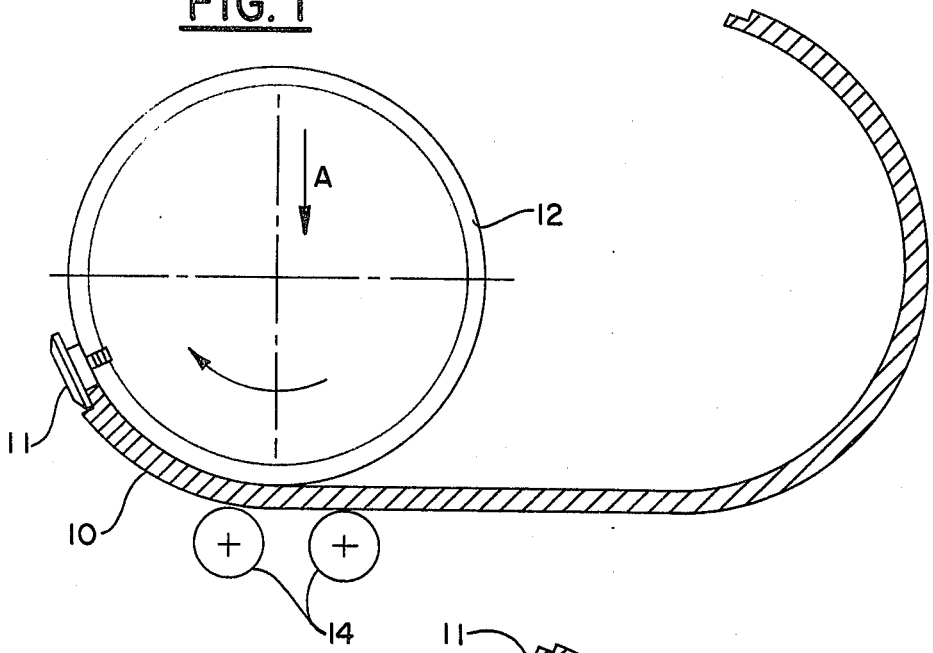
FIG. 1 is a partial sectional view of a gripper and plate.
Figure 2:
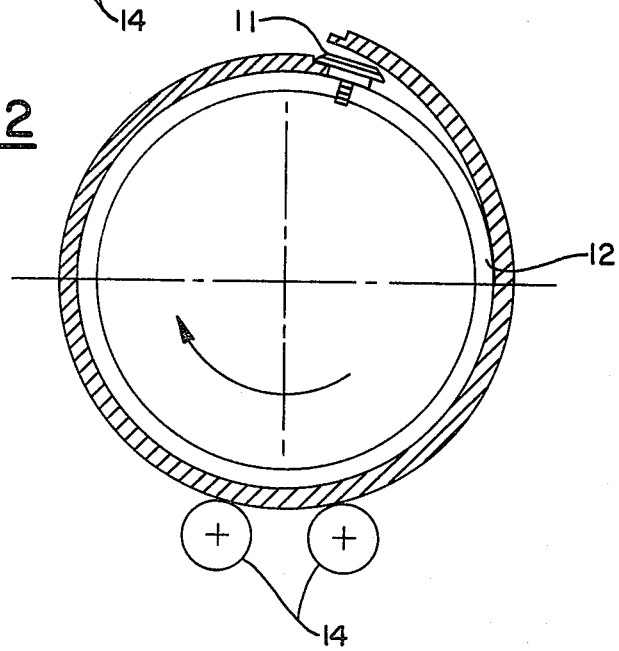
FIG. 2 is an end elevation of a mandrel with a near completed bending operation.

FIG. 1 shows the positioning of a recessed flat plate 10 onto the gripper 11. The mandrel 12 is rotatably mounted on a horizontal axis. The mounting means for the mandrel is mounted for controlled up and down movement under the influence of preferably hydraulic power cylinders (not shown). Upon location of the plate adjacent to the gripper 11, the mandrel 12 is moved down in the direction of arrow A to engage the pressure rollers 14 and is rotated towards the plate edge to force the edge of the plate home into full engagement with the gripper means 11. The effect of moving mandrel 12 is to ensure surface to surface contact along the entire length of the plate with the mandrel as the plate edge is being forced into the gripper. This ensures that any irregularity in the plate edge is removed as the edge is forced into the gripper. After engagement of the plate the mandrel is rotated in counter clockwise direction to achieve bending of the plate in accordance with the herein mentioned patent; this is achieved by maintaining contact with pressure rollers 14.

A similar procedure is followed in stage 2 of the bending operation when gripping the opposite edge of the plate prior to bending the uncurved half of the plate.

The notching or recessing of the plate is necessary where its thickness to diameter ratio exceeds a maximum limit. The gripper 11 must be radially dimensioned within limits to enable acceptance of the plate edge because of the possibility of fouling with the curved plate during the final stages of curving. Thus a recess is machined in the edges of the plate so that the gripper can be accommodated within the total plate thickness relative to the recessed plate edge and enables curving of thick plates on relatively small diameter mandrels. The reduced thickness of the recessed plate edge enables curving of thick plates on relatively small diameter mandrels. Thus it is possible for the (D/t) ratio (where D is the pipe diameter and t plate thickness) to improve from approximately 30 to about 25 on structural grade steels and from about 20 to about 16 on high strength steels.

I claim:

1. A method of rolling plate to form a cylindrical article which comprises gripping a leading edge of a length of plate with a mandrel gripper so that the plate is tangential to the mandrel from the said edge; rotating the mandrel while engaging the remainder of the plate against the mandrel by pressure means to move the plate to curve a forward part of the plate about the mandrel into a semi-cylindrical shape; subsequently further advancing the plate until the rearward part of the plate and its trailing edge pass beyond contact with the mandrel; and then gripping the said trailing edge with the mandrel gripper and turning the mandrel again to curve the rearward part of the plate about the mandrel into a semi-cylindrical shape so that said forward and rearward parts together complete the formation of a cylinder; the improvement comprising the steps of: forming a recess in the leading and trailing edge portions of the plate before curving the plate; selecting a plate thickness greater than said recessed edge portions by an amount equal to the depth of said recesses; serially gripping said recessed leading and trailing edge portions with said mandrel gripper so that the unrecessed plate thickness is substantially the same as the maximum radial dimension of the mandrel gripper to thereby form a cylinder of small diameter for a given plate thickness having a smaller diameter to plate thickness ratio.

2. The invention as claimed in claim 1 wherein the depth of said recesses is about half the plate thickness.

* * * * *